United States Patent [19]

Meijer

[11] 4,215,501

[45] Aug. 5, 1980

[54] LIGHT EFFICIENT DISPLAY DEVICE

[75] Inventor: Leo Meijer, Green Bay, Wis.

[73] Assignee: Ten-O-One Inc., Green Bay, Wis.

[21] Appl. No.: 862,927

[22] Filed: Dec. 21, 1977

[51] Int. Cl.[2] ..... G09F 13/02; G09F 13/04; G09F 13/16

[52] U.S. Cl. ..... 40/559; 40/582

[58] Field of Search ..... 40/582, 559, 564

[56] References Cited

U.S. PATENT DOCUMENTS

| | | | |
|---|---|---|---|
| 250,576 | 12/1881 | Read | 40/158 R |
| 1,436,092 | 11/1922 | Heaton | 40/542 |
| 1,973,792 | 9/1934 | Barrows | 40/615 |
| 2,089,351 | 8/1937 | English | 40/615 X |
| 2,301,471 | 11/1942 | Stewart | 40/559 X |
| 2,603,017 | 7/1952 | Merrill | 40/152 |
| 2,613,465 | 10/1952 | View | 40/543 |
| 2,699,620 | 1/1955 | Smythe | 40/564 X |
| 3,056,222 | 10/1962 | Boudouris | 40/615 X |
| 3,163,554 | 12/1964 | Gessler | 40/564 X |
| 3,268,379 | 8/1966 | Baker | 156/63 |
| 3,583,298 | 6/1971 | Van Swearingen | 40/542 |
| 3,591,942 | 8/1967 | Van Swearingen | 40/615 |
| 3,680,238 | 8/1972 | Arnold | 40/564 |
| 3,830,682 | 8/1974 | Rowland | 428/142 |
| 3,977,111 | 8/1976 | Fritts | 40/564 |
| 4,016,309 | 4/1977 | Itoh | 40/564 X |

FOREIGN PATENT DOCUMENTS

| | | | |
|---|---|---|---|
| 596675 | 4/1960 | Canada | 40/564 |

OTHER PUBLICATIONS

Barnoski, *Introduction to Integrated Optics,* Plenum Press N.Y., 1974, pp. 8–19.

*Primary Examiner*—John F. Pitrelli
*Assistant Examiner*—G. Lee Skillington
*Attorney, Agent, or Firm*—Russell L. Johnson

[57] ABSTRACT

This invention relates to a contrast maintaining means for use in display devices. The invention uses a substrate of synthetic paper having a light reflectance to light transmittance ratio which is in the order of 1 to 1. A substantially opaque coating material having a light reflection index near zero is deposited in the desired pattern upon the substrate so as to provide an information carrying display. The coated areas of the display neither transmit nor reflect a significant amount of light. When light reaches the display from behind the light transmitted through the substrate is of substantially the same intensity as the light that would be reflected from the substrate if the same light had reached the display from the front. The light reaching a viewers' eyes from the uncoated areas of the substrate is constant for nearly all lighting angles while substantially no light reaches the viewers' eyes from the coated areas of the display. The contrast ratio between the light coming to the viewers' eyes from the coated areas of the display and the light coming to the viewers' eyes from the uncoated areas of the display is virtually a constant ratio for any given lighting level of the display regardless of the directions of the light sources.

4 Claims, 4 Drawing Figures

FIGURE 1
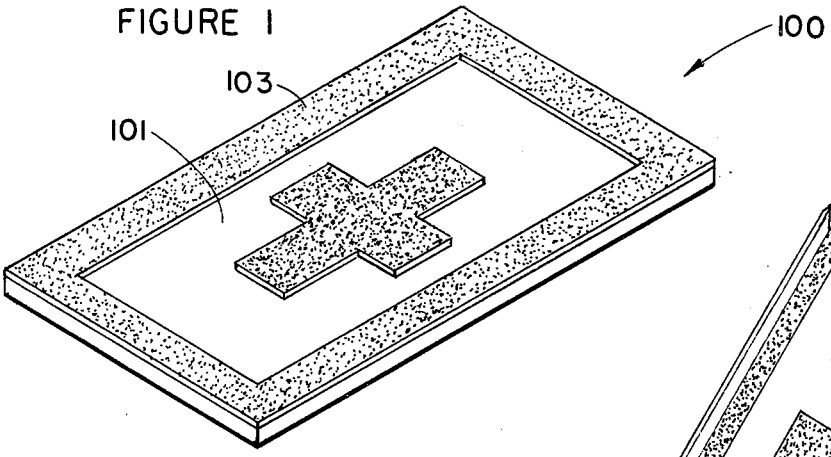
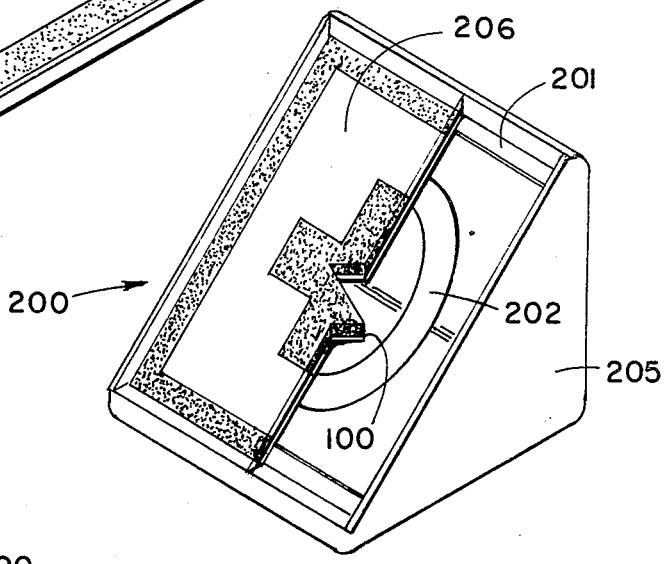
FIGURE 2
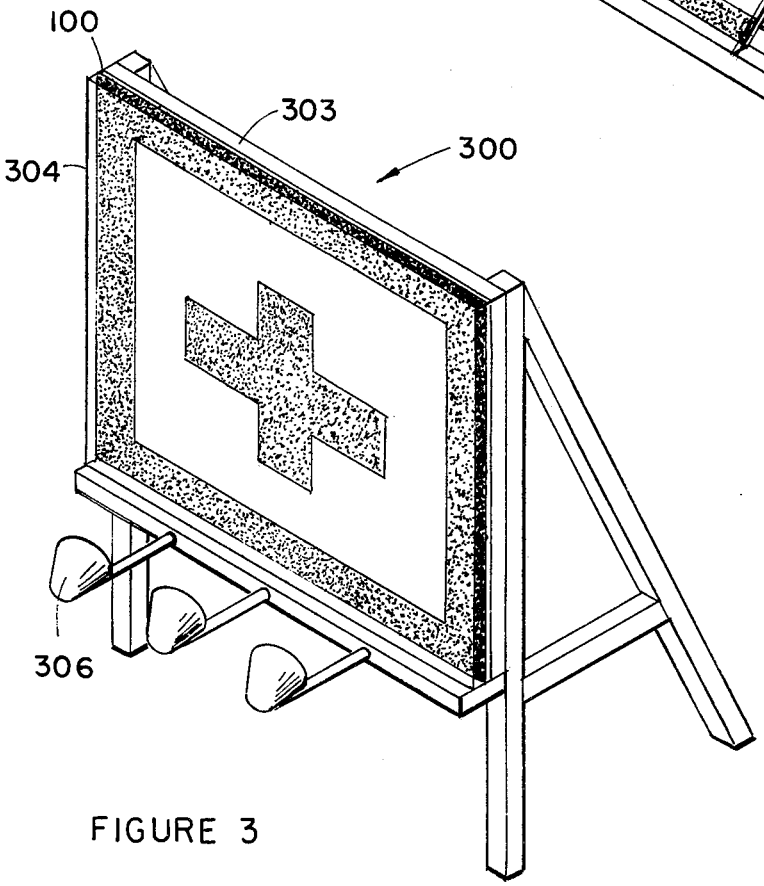
FIGURE 3
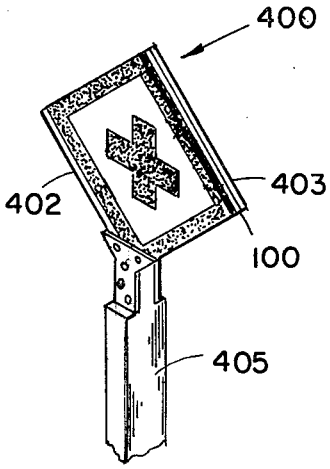
FIGURE 4

LIGHT EFFICIENT DISPLAY DEVICE

HISTORY OF THE INVENTION

The term "light transmission" as used herein should be read to mean; the total light coming from a location on a display device and which originates on one side of the display device and reaches the eye of a viewer on the other side of the display device.

The term "light reflectance" as used herein should be read to mean the total light coming from a location on a display device and which originates on one side of the display device and which reaches the eye of a viewer who is on the same side of the display device as is the light source.

The expression "contrast" level as used herein should be read to mean the perceived visual difference between two locations on a display device and the differences are due to the difference between the amount of light which reaches a viewer's eye from one location on the display device and the amount of light reaching the viewer's eye from a different location on the device.

People have attempted to improve the legibility of graphic display devices by two means. First, they sought to improve the lighting of the display in order to provide the best lighting possible for the purpose of making the display more legible. Second, they sought to increase the contrast between the elements of the display in order to make the display more legible under lighting conditions which were less than optimum. Neither of the two approaches are of much use in adverse lighting conditions such as the glare situations created by the rising and setting sun or when the display is viewed against the glare of oncoming car headlights.

FIELD OF THE INVENTION

This invention relates to a means whereby the contrast levels between the elements of a graphic display device are rendered to be substantially constant for a given light level regardless of the directions from which the light reaches the display device. The invention further relates to a means whereby the contrast levels between the elements of a display device are increased when the lighting level reaching the display device is increased. The invention further relates to a means for providing a graphic display device which may not only serve beneficially in the roles served by conventional display devices but may also serve in roles involving adverse lighting conditions in which conventional display devices become illegible.

DISCUSSION OF THE PRIOR ART

The present invention uses readily available and well known means in a novel way to achieve an end not previously sought after or achieved by the prior art. The prior art does not disclose nor teach a means for providing a graphic display device wherein the contrast levels between the elements of the display device are substantially constant levels for a given lighting level and which are independent of the directions of the light sources.

Prior art graphic display devices may be divided into four groups:

(1) front lighted displays such as highway billboards,
(2) back lighted displays such as commercial displays,
(3) unlighted displays such as highway signs, and (4) displays using reflective and phosphorescent materials.

U.S. Pat. No. 3,680,238 to Arnold and U.S. Pat. No. 2,878,606 to Meijor are examples of prior art references which provide back lighted display devices employing translucent and opaque elements in cooperation with a back lighting source in order to provide heightened contrast levels which will enhance the legibility of the display. It should be noted that devices of the species disclosed in the above cited references require multiple layers of elements to create the display and that one of the layers is normally a photographic negative which is expensive to make. The instant invention, in counter distinction, would provide a single graphic display element to such signs. The graphic display element can be simply and economically formed and reproduced by conventional printing methods such as offset and screen printing upon a substrate having the optical properties taught by the invention.

U.S. Pat. No. 3,591,942 to Van Swearingen and U.S. Pat. No. 1,436,092 to Heaton are examples of prior art references which disclose front lighted displays which employ light reflectance and/or fluorescent means used in conjunction with low reflectance or opaque elements to heighten the contrast and light efficiency of the display device and thereby improve the legibility of the display. The complex structures and costly materials of these display devices are in sharp contrast to the simple and economical elements of the instant invention. Highway signs and unlighted billboards are examples of prior art devices which are dependent upon daylight or unrestricted light sources for illumination. These prior art devices are rendered illegible when viewed against a strong light source such as the sun or oncoming car headlights. Heretofore the prior art has not provided a means for rendering such displays or signs legible under these adverse conditions. The instant invention provides a simple, economical, and readily reproduced light efficient display device which maintains legibility under the adverse lighting conditions recited above.

DESCRIPTION OF THE INVENTION

The invention in its simplest form comprises a sheet of substrate having optical properties such that approximately one half of the light incident on one surface of the substrate will be reflected from that surface and approximately one half of the light incident on that one surface will be transmitted through the substrate and will be emitted from the other surface. The substrate having indicia formed thereon by depositing a coating on the substrate. The coating material being a substantially opaque and non-reflecting material.

EXAMPLE

A preferred substrate is biaxially oriented polystyrene sold under the name of EVE 2 by Appleton Papers Division of NCR. It has a light transmission to light reflectance ratio of very nearly 1 to 1, (measured values are in the order of 0.36:0.41). A preferred coating material is iron-oxide pigmented latex metha-acrylic sold under the name of "Lightstop" by Ten.O.One Inc. When printed on the substrate by the silkscreen process it has a light transmission index of very nearly zero and a light reflectance index of very nearly zero.

Under some conditions the invention may serve its intended purposes without the need for additional aids. More often the display device will be used in conjunction with a display holder. The use of lighting means, housings, and weather and dirt protection may also be desirable in many applications.

BRIEF DESCRIPTION OF THE DRAWINGS

FIG. 1 is a pictorial drawing of the display device of this invention in its simplest form.

FIG. 2 is a partially sectioned pictorial view of the display device of this invention used in conjunction with a back lighted commercial display.

FIG. 3 is a pictorial view of the display device of this invention used in conjunction with a front lighted billboard.

FIG. 4 is a pictorial view of the display device used in conjunction with an unlighted highway sign.

DETAILED DESCRIPTION OF THE DRAWINGS

Referring now to FIG. 1. Display device 100 comprises a substrate 101 of translucent material. Substrate 101 may be a synthetic paper such as biaxially oriented polystyrene or the like having a light reflectance to light transmission ratio in the range between 1.5 to 1 and 1 to 1.5. Coating material 103 is deposited on substrate 101 to form an information carrying display. Coating material 103 may be iron-oxide pigmented latex methacrylic and the like having a light transmission near zero and a light reflectance near zero. Coating material 103 may be deposited on substrate 101 by conventional printing means such as screen printing, offset printing or the like. Alternatively coating material 103 may be cut from a sheet of low reflectance opaque material and adhered to substrate 101. The thickness of substrate 101 and coating material 103 have been exaggerated, for the sake of illustration. Display device 101 may be used without additional aids.

Example 1 An advertising display for a commercial business establishment may be created as described in the discussion of FIG. 1. The display device may be secured to the window of the establishment. The display would ordinarily be illuminated from the front during the day by daylight. During the night time hours the display would be illuminated from the back by the store lights. The display would provide a nearly constant level of contrast and readability throughout the business hours of the establishment.

As discussed above the display device of this invention does not require additional aids for its effective use. However, it should be pointed out that while the contrast levels between the substrate and the coating materials is substantially constant for any given lighting level that an increase in the lighting level will result in an increase in the contrast level of the display. The increase in the contrast level is due to the increase in the light transmitted and/or reflected from the substrate due to the increase in incident light. The light transmitted and/or reflected from the coating remains near zero. Therefore it will sometimes be found desirable to provide the display device with a display lighting means. The display device is preferably formed from relatively thin and flexible materials. It will often be found desirable to provide the display device with a holder for the display. Where the display is subjected to the outdoor elements or otherwise found to require additional protection and/or support, the display may be provided with a protective cover and/or housing.

Referring now to FIG. 2. Commercial display 200 is a back lighted display wherein display device 100 is seated in holder rim 201 and back lighted by illuminating means 202, here shown as a circular fluorescent tube. Display device 100 and illuminating means 202 are contained within and protected by housing 205 and transparent cover 206.

Referring now to FIG. 3. Billboard 300 is a front lighted commercial display employing display device 100. Display device 100 is supported and protected by rigid backing 303 and transparent cover 304. Illuminating means 306 provides the desired night lighting level for display device 300. Rigid backing 303 may be transparent or opaque.

Referring now to FIG. 4. Road sign 400 is a non-specifically illuminated sign using the display device of this invention. Display device 100 is supported and protected by rigid transparent holders 402 and 403. Holders 402 and 403 are secured to and supported by post 405. Illumination of sign 400 may be supplied by daylight or the light from cars approaching sign 400 from either direction at night or any other incident light reaching sign 400 such as moonlight and light from nearby establishments.

Presently used road signs depend upon reflected light to render them legible to the observer. They therefore provide only a silhouette during low light levels at night and the information contained on the signs is illegible. A road sign employing the display device of this invention as described in conjunction with FIG. 4 will be legible under such low lighting level conditions. A second adverse lighting condition which renders conventional road signs illegible is one of intense back lighting conditions such as viewing against the sun or against the glare of car headlights. Under these conditions only the silhouette of the road sign is seen and the information on the sign is rendered illegible. A road sign configured as described in FIG. 4 will be legible in all but the most severe of these lighting conditions.

The display device of this invention may also serve well in circumstances where lighting conditions make the reading of printed matter difficult if not impossible. Lighting conditions such as those that sometimes arise in moving automobiles and airplanes where glare and continuously changing lighting conditions make reading difficult are one set of conditions where the device of this invention may be beneficially employed. Another set of conditions where the device of this invention possesses utility are the low level lighting conditions in restaurants where menues, like wine lists and the like, are difficult to read due to poor lighting conditions for reading.

The preferred embodiment of the invention has been disclosed and described herein. Examples of means for beneficially employing the invention have also been disclosed and discussed. It would be obvious for one skilled in the art to employ the display device of this invention in many other ways. A recitation of all the obvious employments for the instant invention would unduly multiply the drawings and cause the specifications to become prolix. Many effectiveness enhancing means would also suggest themselves to one skilled in the art. Such enhancements might be the employment of transparent or translucent colored media in conjunction with the substrate and/or the use of fluorescent or phosphorescent materials in conjunction with a display device.

Therefore it should be clearly understood that the scope of the invention should be limited only by the scope of the appended claims and all equivalents thereto which would be apparent to one skilled in the art.

What is claimed is:

1. A light efficient display device comprising;

(a) a translucent substrate having a front and a rear surface said substrate having optical properties such that approximately one half of the light incident on one of the surfaces of the substrate will be reflected from that surface and approximately one half of the light incident on that one surface will be transmitted through the substrate and will be emitted from the other surface, (b) indicia formed on the front surface of the substrate (c) said indicia being a substantially opaque and non-reflective coating and (d) whereby there is a contrast between the indicia and the uncoated portion of the substrate and said contrast remains constant whether the light is incident upon the front surface or is incident upon the rear surface if the incident light is constant in both cases.

2. The light efficient display device of claim 1 wherein the substrate is s synthetic paper such as biaxially oriented polystyrene and the surface coating material is a flat black printing media such as iron-oxide pigmented latex metho-acrylic.

3. The light efficient display device of claim 1 wherein the device is primarily a rear lighted device comprising;

(a) a holder for the display device, (b) a light source which is positionally fixed relative to the rear surface of the display device, (c) a protective means for the purpose of shielding the device from elements in its environment and for preventing the undesired escape of light into areas surrounding the display device.

4. The light efficient display device of claim 1 wherein the device is primarily a front lighted device comprising;

(a) a holder for the display device, (b) a light source which is positionally fixed relative to the front surface of the display device, and (c) a protective means for the purpose of shielding the device from elements in its environment and for preventing the undesired escape of light into the areas surrounding the display device.

* * * * *